US009711006B2

(12) United States Patent
Kendall

(10) Patent No.: US 9,711,006 B2
(45) Date of Patent: Jul. 18, 2017

(54) ELECTRONIC METHOD OF GAMING, A GAME CONTROLLER AND A GAMING SYSTEM

(71) Applicant: Aristocrat Technologies Australia Pty Limited, North Ryde, NSW (AU)

(72) Inventor: Karen Michelle Kendall, Toongabbie (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 22 days.

(21) Appl. No.: 13/860,327

(22) Filed: Apr. 10, 2013

(65) Prior Publication Data

US 2014/0295942 A1 Oct. 2, 2014

(30) Foreign Application Priority Data

Mar. 28, 2013 (AU) ..... 2013202150

(51) Int. Cl.
*G07F 17/34* (2006.01)
*G07F 17/32* (2006.01)

(52) U.S. Cl.
CPC ..... *G07F 17/326* (2013.01); *G07F 17/3213* (2013.01); *G07F 17/3267* (2013.01)

(58) Field of Classification Search
CPC ..... G07F 17/32; G07F 17/34; G07F 17/3267; G07F 17/3213; G07F 17/3262
See application file for complete search history.

(56) References Cited

U.S. PATENT DOCUMENTS

| | | | | |
|---|---|---|---|---|
| 6,656,040 | B1 | 12/2003 | Brosnan et al. | |
| 7,643,833 | B2 | 1/2010 | Sankisa | |
| 8,888,582 | B2 * | 11/2014 | Louie et al. | 463/21 |
| 2005/0093227 | A1 | 5/2005 | Sines | |
| 2005/0221886 | A1 | 10/2005 | Itagaki et al. | |
| 2006/0194589 | A1 | 8/2006 | Sankisa | |

(Continued)

FOREIGN PATENT DOCUMENTS

| | | |
|---|---|---|
| AU | 2002310115 | 12/2002 |
| GB | 2466714 A | 7/2010 |

(Continued)

*Primary Examiner* — James S McClellan
*Assistant Examiner* — Kevin Carter
(74) *Attorney, Agent, or Firm* — McAndrews, Held & Malloy, Ltd.

(57) ABSTRACT

An electronic method of gaming comprising independently conducting at least two different games in individual ones of a plurality of display areas, each different game conducted based on game data specific to the game, the game data of each different game defining a set of game play rules for the specific game comprising a base game portion carried out each time the specific game is played and a first feature game portion carried out upon a first trigger condition being met such that there are a plurality of base game portions and a plurality of first game portions corresponding to respective ones of the plurality of different games, and upon a first trigger condition being met in respect of one of the games, conducting, in each of the display areas, separate instances of the first feature game portion of the specific game in respect of which the first trigger condition was met, to determine whether to make one or more awards to the player.

12 Claims, 7 Drawing Sheets

(56) References Cited

U.S. PATENT DOCUMENTS

| | | | | |
|---|---|---|---|---|
| 2007/0123340 | A1 | 5/2007 | Vancura | |
| 2000/0173355 | | 7/2007 | Klein | |
| 2008/0026848 | A1* | 1/2008 | Byng | G07F 17/32 463/42 |
| 2009/0011820 | A1 | 1/2009 | Toyoda | |
| 2009/0121474 | A1 | 5/2009 | Hughes | |
| 2009/0124340 | A1* | 5/2009 | Visser | G07F 17/3267 463/20 |
| 2009/0227358 | A1 | 9/2009 | Yoshizawa | |
| 2009/0233708 | A1 | 9/2009 | Kato | |
| 2009/0239664 | A1 | 9/2009 | Yoshizawa | |
| 2010/0056246 | A1 | 3/2010 | Lai | |
| 2010/0184516 | A1 | 7/2010 | Matsumura | |
| 2011/0105218 | A1* | 5/2011 | Anderson et al. | 463/20 |
| 2011/0136572 | A1 | 6/2011 | Karn | |
| 2013/0260864 | A1* | 10/2013 | Gomez et al. | 463/20 |
| 2014/0141857 | A1* | 5/2014 | Meyer | 463/20 |

FOREIGN PATENT DOCUMENTS

| | | | |
|---|---|---|---|
| JP | 2002058871 | A | 2/2002 |
| JP | 2003236040 | A | 8/2003 |
| JP | 2006326041 | A | 12/2006 |
| JP | 2007021022 | A | 2/2007 |
| JP | 2008220783 | A | 9/2008 |
| JP | 2009100802 | A | 5/2009 |
| JP | 2010240389 | A | 10/2010 |
| MX | PA04002888 | A | 7/2004 |
| NZ | 525627 | A | 2/2005 |
| WO | 02/099760 | | 12/2002 |

* cited by examiner

ELECTRONIC METHOD OF GAMING, A GAME CONTROLLER AND A GAMING SYSTEM

RELATED APPLICATIONS

This application claims priority to Australian Patent Application No. 2013202150 having an International filing date of Mar. 28, 2013, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Gaming systems in the form of electronic gaming machines are known where a player can select a game to play from a plurality of different games.

While such gaming systems provide players with enjoyment, a need exists for alternative gaming systems in order to maintain or increase player enjoyment.

BRIEF SUMMARY OF THE INVENTION

In a first aspect, the invention provides an electronic method of gaming comprising:

independently conducting at least two different games in individual ones of a plurality of display areas, each different game conducted based on game data specific to the game, the game data of each different game defining a set of game play rules for the specific game comprising a base game portion carried out each time the specific game is played and a first feature game portion carried out upon a first trigger condition being met such that there are a plurality of base game portions and a plurality of first game portions corresponding to respective ones of the plurality of different games; and upon a first trigger condition being met in respect of one of the games, conducting, in each of the display areas, separate instances of the first feature game portion of the specific game in respect of which the first trigger condition was met, to determine whether to make one or more awards to the player.

In an embodiment, the game data of each game also defines a second feature game, a single instance of which, is to be conducted upon a second trigger condition being met.

In an embodiment, the first and second feature games such that the difference in game play is that upon the second trigger condition being met, a single instance of the feature game is carried out whereas upon the first trigger condition being met, the feature game is conducted in the display area corresponding each different game selected by the player.

In an embodiment, the electronic method further comprises determining that an eligibility criterion is met prior to conducting the first feature game.

In an embodiment, the eligibility criterion comprises a player selecting a defined minimum number of games to be conducted.

In an embodiment, the eligibility criterion comprises a player selecting games to be played in each available display area.

In an embodiment, the method comprises adjusting at least one reel of each game to enable the first trigger condition to be met in response to the eligibility criterion being met.

In an embodiment, there are the same number of different games as display areas.

In a second aspect, the invention provides a gaming system, comprising:

a display;

a memory storing game data of a plurality of different games, the game data of each different game defining a set of game play rules for the specific game comprising a base game portion carried out each time the specific game is played and a first feature game portion carried out upon a first trigger condition being met such that there are a plurality of base game portions and a plurality of first game portions corresponding to respective ones of the plurality of different games; and a game controller arranged to control the display to display a plurality of display areas and to conduct games within the display areas based on the game data of the respective games upon a first trigger condition being met in respect of one of the games, conducting, in each of the display areas, separate instances of the first feature game portion of the specific game in respect of which the first trigger condition was met, to determine whether to make one or more awards to the player.

In a third aspect, the invention provides a game controller for a gaming system, the game controller arranged to:

control a display to display a plurality of display areas;

conduct games within different ones of the display areas based on the game data of the respective ones of the games, the game data of each different game defining a set of game play rules for the specific game comprising a base game portion carried out each time the specific game is played and a first feature game portion carried out upon a first trigger condition being met such that there are a plurality of base game portions and a plurality of first game portions corresponding to respective ones of the plurality of different games; and upon a first trigger condition being met in respect of one of the games, conducting, in each of the display areas, separate instances of the first feature game portion of the specific game in respect of which the first trigger condition was met, to determine whether to make one or more awards to the player.

In a fourth aspect, the invention provides a gaming system, comprising:

a display;

a memory storing game data of a plurality of different games;

a game controller arranged to control the display to display a plurality of display areas and to conduct games selected by a player within the display areas based on the game data of the respective games; and a player interface operable by the player to select a game to be conducted and select the display area in which the game is to be conducted.

In an embodiment, there are at least three display areas.

In an embodiment, at least during a selection period, the game controller controls the display to display icons corresponding to each of the different games, and the player interface is operable to select an icon and move the icon to a display area to thereby select the game and the display area in which the game is to be conducted.

In an embodiment, the player interface includes a touch screen operable by the player to move the icon.

In a fifth aspect, the invention provides an electronic method of gaming comprising:

controlling a display to display a plurality of display areas;

receiving instructions from a player via a player interface specifying selections of games of a plurality of different games having respective game data stored in a memory and also selecting the display area in which each game is to be conducted; and conducting games selected by the player within the display areas based on the game data of the respective games.

In a sixth aspect, the invention provides computer program code which when executed implements the above method.

In a seventh aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
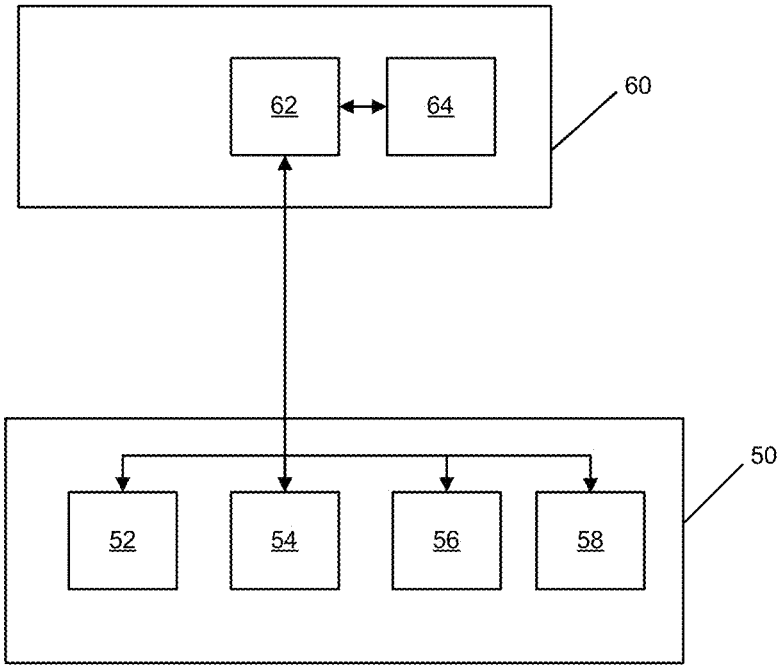
FIG. 1 is a block diagram of the core components of a gaming system.

Referring to the drawings, there is shown an embodiment of a gaming system having a game controller arranged such that a player can play a plurality of different games concurrently. The game controller conducts the games in respective ones of a plurality of different display areas. The game rules of each game provide for the possibility of a super feature being triggered in which instances of a feature game based on the game rules of a triggering game are carried out in each of the display areas. The gaming system also has a player interface which allows a player to choose which of the games to play and in which display areas the games are to be conducted.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
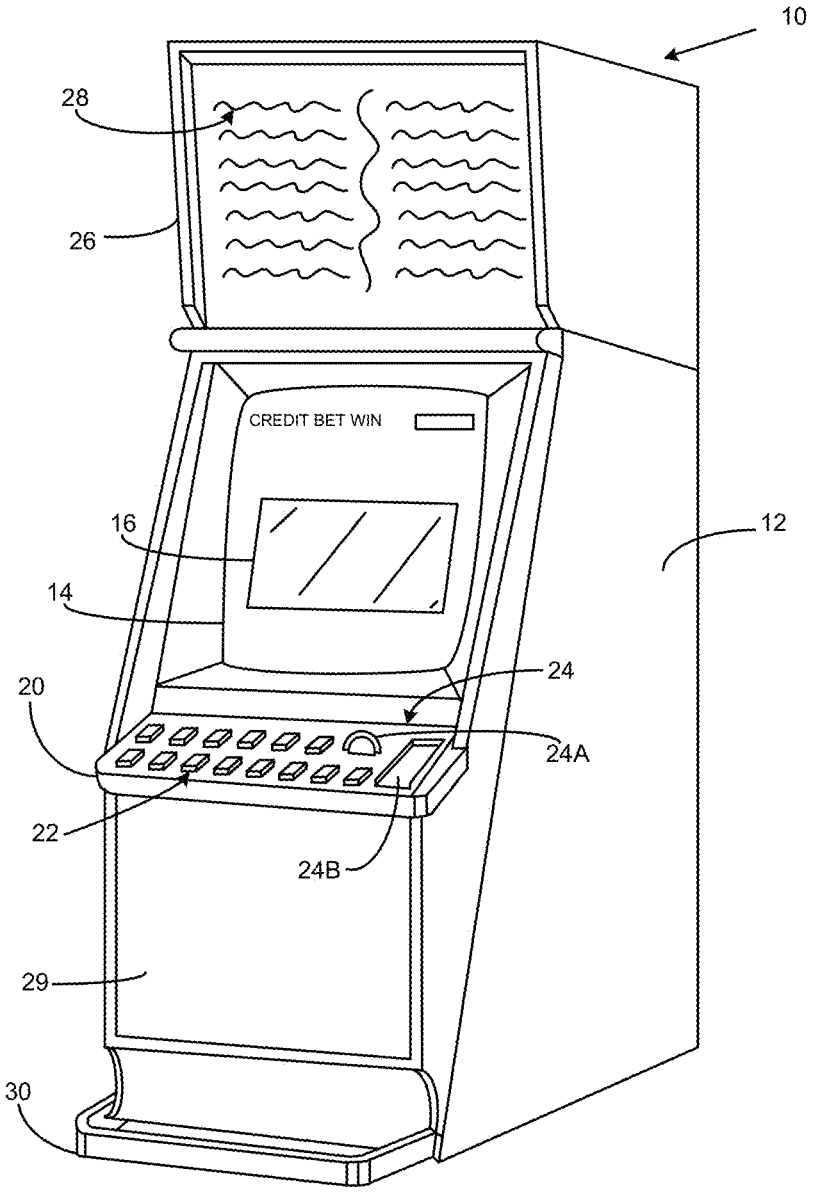
FIG. 2 is a perspective view of a standalone gaming machine.

A gaming system in the form of a standalone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit. The top box 26 may also include a display, for example a video display unit, which may be of the same type as the display 14, or of a different type.

Figure 3:
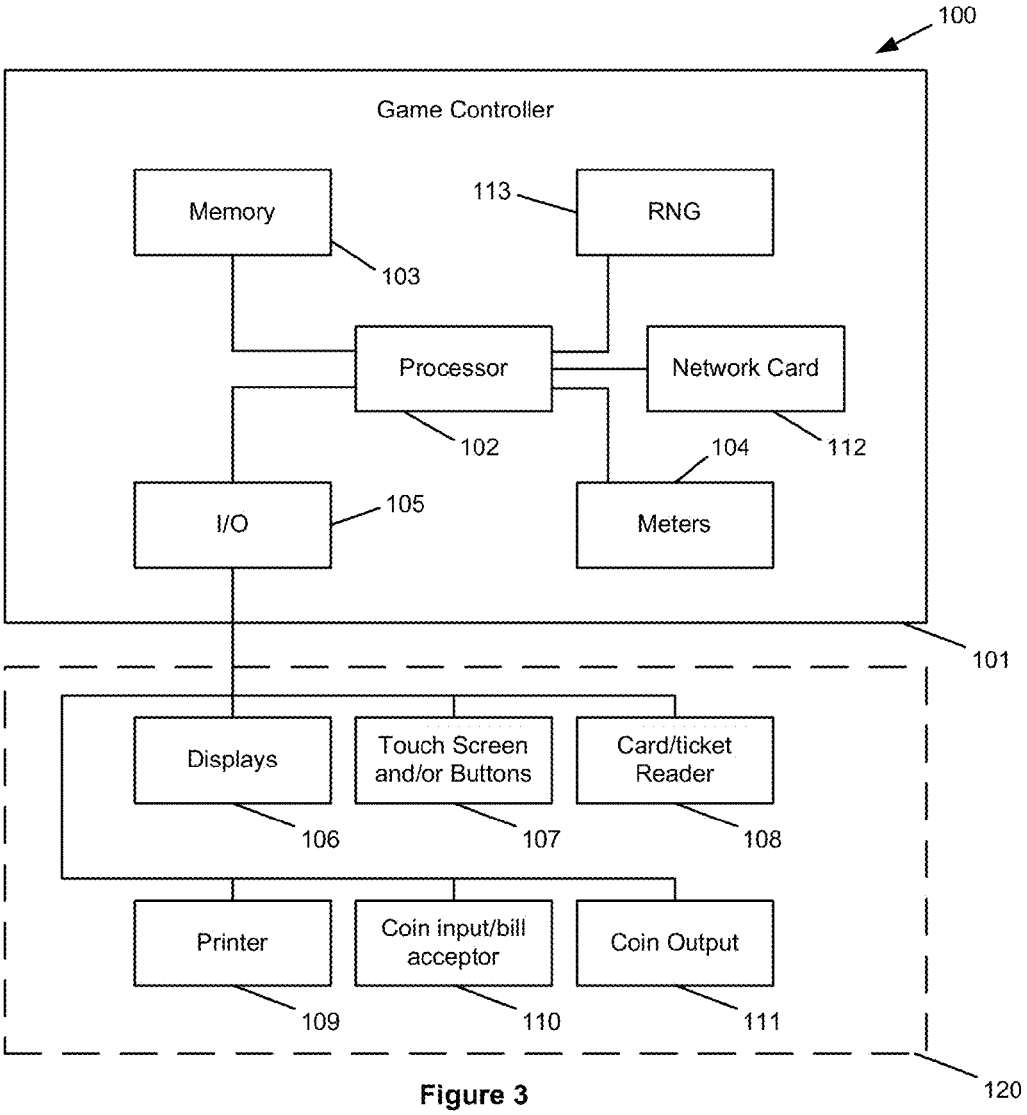
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
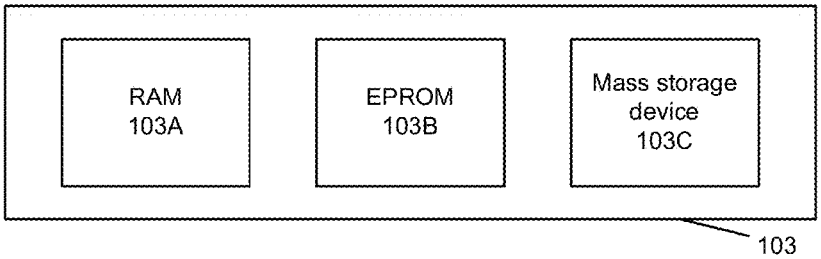
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
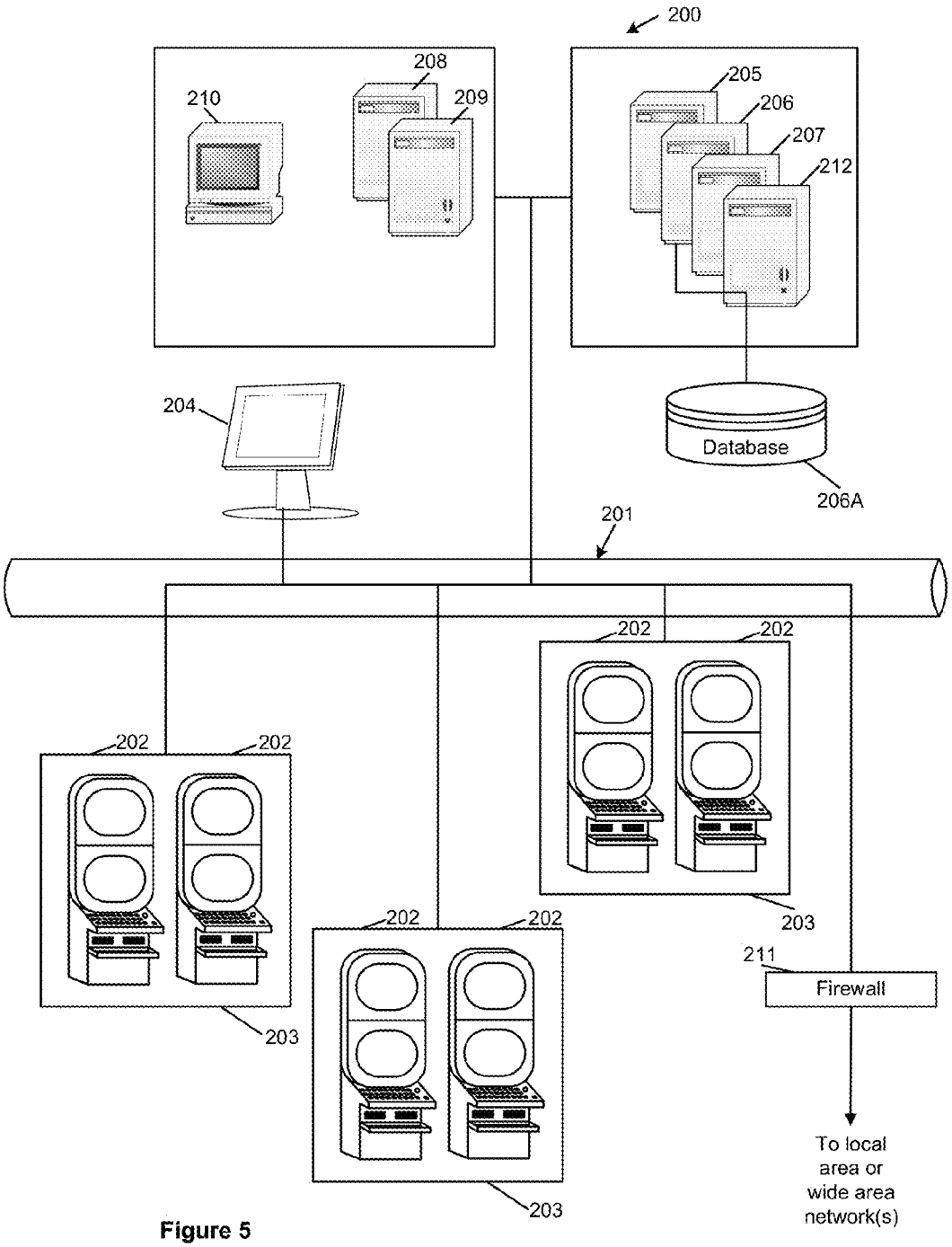
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

Figure 6:
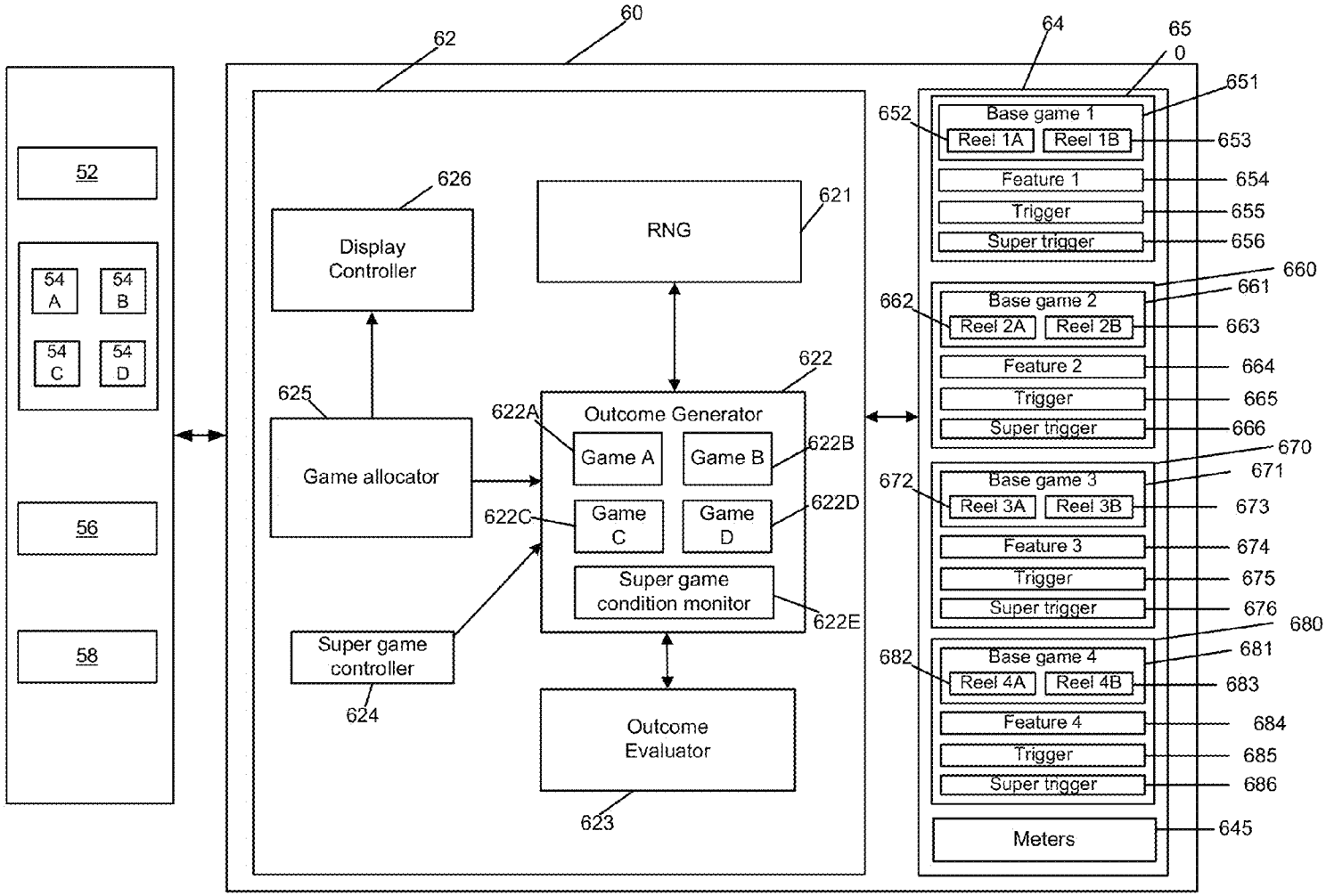
FIG. 6 is a further block diagram of a gaming system.
Figure 7:
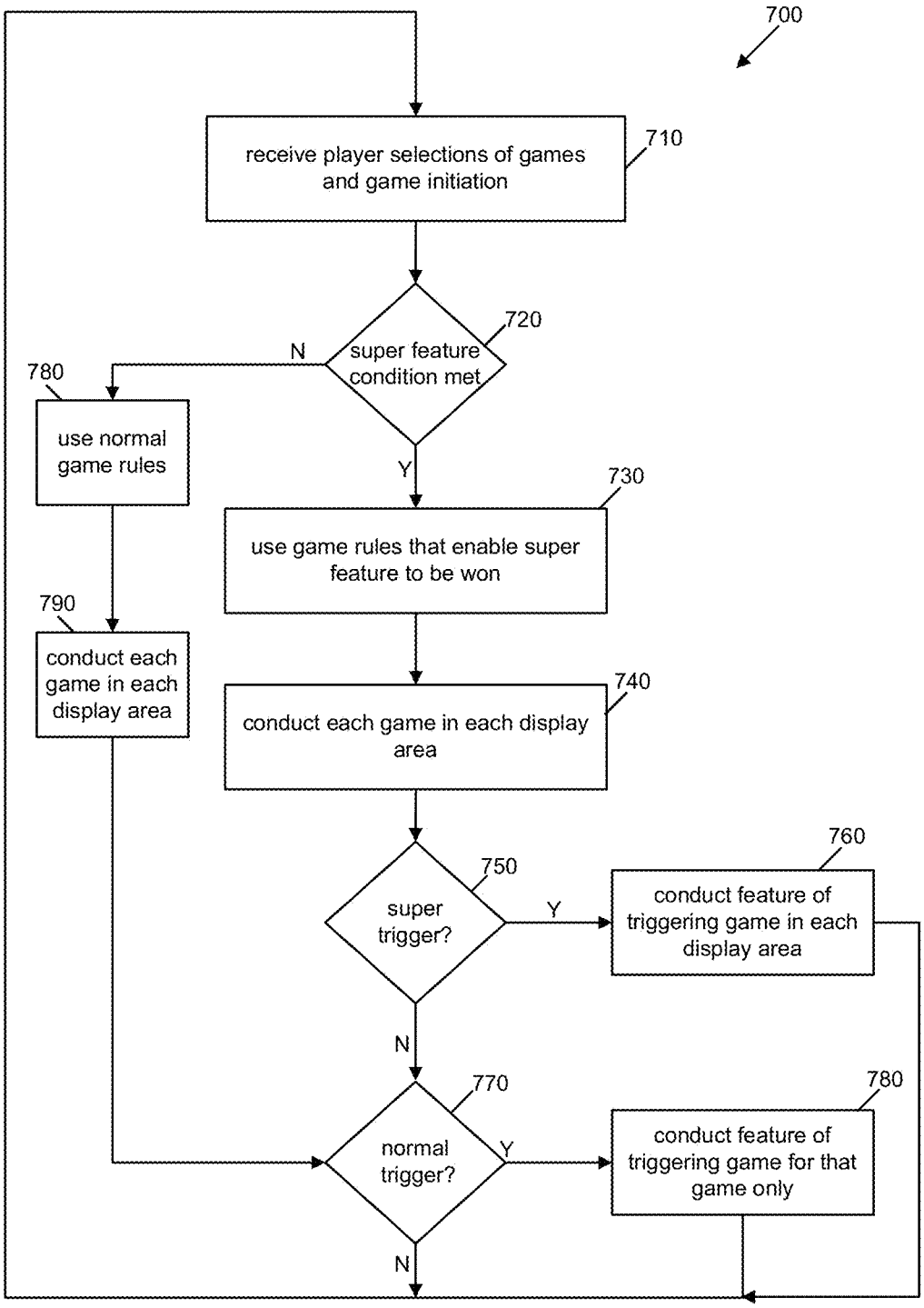
FIG. 7 is a flow chart of an embodiment.
Figure 8:
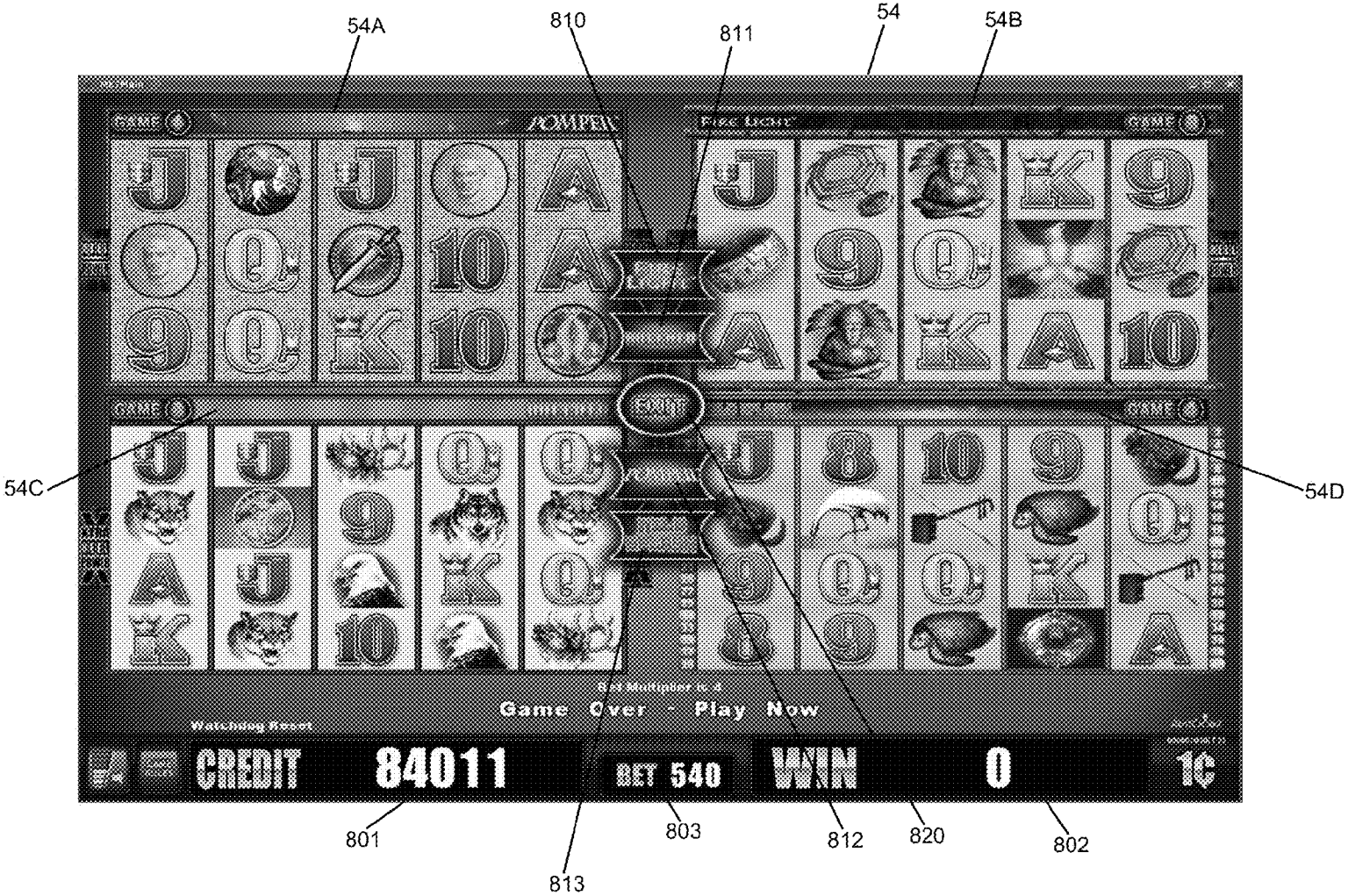
FIG. 8 is an exemplary display of an embodiment.

FIGS. 6 to 8 show specific details of implementation of the embodiment. In the example of FIGS. 6 to 8, the player can play up to four different games in separate display areas 54A, 54B, 54D on display 54. In the embodiment, the player can select between one and four different games and can select to play any combination of the games. For example, the player can select to play all four different games or one instance of one game, two instances of a second game and one instance of a third game. The player may also select less than four games.

In this respect, memory 64 of game controller 60 stores game data for the first game 650, second game 660, third game 670, and fourth game 680. The player interacts with a game allocator function 625 of the game controller 60 to allocate the games. In this respect, outcome generator 622 is arranged to generate outcomes for up to four different game instances. This is represented in FIG. 6 by the fact that the outcome generator including provision to generated outcomes for Game A 522A, Game B 622B, Game C 622C, and Game D 622D. These game instances are linked to respective ones of the display areas 54A to 54D. The game allocator 625 is operable by the player using player interface 56 so that the first to fourth games 650 to 680 can be allocated to any one of the game instances Game A to Game D and hence can be allocated to any one of the display areas 54A to 54D. In this way, the player has full control over not only which games are played but also where they are displayed. This allows the player to exercise personal preference over not only which games are conducted but where they are conducted on the display. For example, the player may wish to place a particular game in a particular area which the player finds easiest to monitor.

A specific mechanism for the player to allocate games is shown in FIG. 8 which shows an exemplary display 54 of the game. The display area includes a plurality of sub-display areas 54A to 54D. The display also includes a credit meter 801, a win meter 802 and a bet meter 803. Icons 810, 811, 812, 813 correspond to respective ones of a plurality of the four different games. In the embodiment, a touch screen is incorporated over the display 54 as part of the player interface 56. For a player to allocate a game to a particular display area, the player places their finger on the icon corresponding to the game they wish to select during a selection phase and drags the icon with their finger into the area in which they want the game to be conducted before releasing the icon. This results in population of the display area with the selected game. Accordingly, it can be seen in FIG. 8 that the player has elected to populate the four display areas with the four different games and has chosen a particular selection of areas for each game. Once the player has made their selections they press the exit button 820 so that they can play and view the games.

As well as selecting the games to play, the player operates the game play mechanism 56 to specify a wager for this play of the game and to initiate a play of the game. In the embodiment, the player is restricted in their selection of a wager to only selecting a bet multiplier to apply to all the games. Thus, where a game is a spinning reel game, the other selections are preset. That is, while normally in a line-based spinning reel game, the player may select how many lines they play in each play of the game (e.g. a minimum of one line up to the maximum number of lines allowed by the game) and how much they wager per line, in the embodiment the player plays a defined number of win lines, specifically the maximum number of lines.

In many games, is not strictly limited to the lines they have selected, for example, "scatter" pays are awarded independently of a player's selection of pay lines and are an inherent part of the game.

In other spinning reel games, a player usually selects a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions; the symbols displayed in the centre row are used for non-selected reels. As a result, the total number of ways to win is determined by multiplying the number of active display positions of each reels, the active display positions being all display positions of each selected reel and the designated display position of the non-selected reels. As a result for five reels and fifteen display positions there are 243 ways to win. As in line based games, the player plays a fixed number of reels, specifically, all reels. Persons skilled in the art, will appreciate that this arrangement makes placing the wager on each play of the game straightforward.

In FIG. 6, the processor 62 of game controller 60 is shown implementing a number of modules based on program code and data stored in memory 64. Persons skilled in the art will appreciate that various of the modules could be implemented in some other way, for example by a dedicated circuit.

These modules include the outcome generator 622 which operates in response to the player's operation of game play mechanism 56 to place a wager and initiate a play of the games and generates game outcomes for each of the games which will then be evaluated by award evaluator 623. In the embodiment, generation of each game outcome includes a symbol selector (not shown) selecting symbols using random number generator 621. The selected symbols are advised to the display controller 624 which causes them to be displayed on display 54 at a set of display positions within the display area 54A-D for the game.

One example of selecting symbols is to select symbols for display from a plurality of symbol sets corresponding to respective ones of a plurality of spinning reels. The symbol sets can specify a sequence of symbols for each reel such that a symbol selector can select all of the symbols by selecting a stopping position in the sequence. It is known to use a probability table stored in memory 64 to vary the odds of a particular stop position being selected. Other techniques can be used to control the odds of particular outcomes occurring to thereby control the return to player of the game.

In the embodiment, the gaming system is arranged such that a player can in some instances trigger plural instances of a feature game corresponds to an individual one of the base games upon a trigger condition being met. In the embodiment, this is achieved by instances of the feature game in respect of which the trigger is met being carried out in each of the display areas. In the embodiment, a criterion for the player having eligibility to this "super feature" is that the player is playing game instances in each of the display areas 54A to 54D. To this end, outcome generator 622 includes a super game condition monitor 622E which monitors whether the super game condition is met and controls the outcome generator 622 such that the super game is available.

As is shown in FIG. 6, the game data 650,660,670,680 include the same types of data. Referring to the first game by way of example, each game includes a base game portion 651, two sets of reel data 652, 653, feature game data 654, a first trigger in the form of super trigger 656 and a second trigger in the form of a normal trigger 655. In the example shown in FIG. 6, the main difference between the normal feature game and the super feature game is that in the normal feature game is carried out only in the display area corresponding to the game that triggered the feature whereas in the super feature is carried out in all four display areas.

Further, in the embodiment, in order to control whether the feature game or the super feature game is triggered, different symbols are used on the reels such that the reels vary between a base game from which a super game can be triggered and a base game from which only the feature game can be triggered. In this embodiment, the super trigger involves a symbol present in reel set 653 but not present in reel set 652 and similar considerations apply for each of the other games 660, 670, 680. Accordingly, a super trigger 656 can only occur when the second set of reels 653 are employed. While this is shown as two sets of different reels 652, 653, persons skilled in the art will appreciate that the same effect can be achieved by modifying a particular set of reels.

Further, in the embodiment shown in FIG. 6, each of the feature game comprises a free game series where a plurality of game rounds are conducted of the base game without requiring the player to place a further wager. As is known in the art, this can be done with the same reels as in the underlying base game such as Reels 1B in the case of a super feature game being triggered or Reels 1A in the case of a normal feature game being triggered or can be done with a further modification of the game. For example, additional wild symbols may be added to the reels of the base game to increase the chance of winning in the feature games. Persons skilled in the art will also appreciate that the base and feature games need not necessarily be of the same type or use similar reels to one another, however, in the embodiment in each instance, the super feature game is based primarily on the rules of the feature game conducted in respect for a particular game so that it is apparent to the player that they have triggered a super feature from a particular game.

The game controller 60 also incorporates a super game controller 624 which controls the super game so that all instances are carried out in the respective display areas 54.

Persons skilled in the art will also appreciate that there are also meters 645 which keep track of the players current level of credits, any awards made during a base game, a feature game, or a super feature game and transfer these wins to the credit meter either when the player seeks to cash out or when the player initiates another play of the game.

FIG. 7 illustrates a method of an embodiment of the invention. At step 710 the method involves receiving player selections of games and a game initiation. It is then determined whether a super feature condition is met 720. If a super feature condition is not met, the normal game rules for each of the games are used 780 and the games are conducted in each display area 54A-54D such that if a normal trigger occurs 770 the feature of the triggering game is conducted for that game only in its relevant display area. If a super feature condition is met, the game rules are used which enable the super feature to be won 730. In the above example, this involves the selection of a particular set of reels to be used. The games are conducted in each display area 740 and if a super trigger condition is met 750 the plural rounds of the feature game of the triggering game is conducted in each display area.

In some embodiments, it may also be possible for a normal trigger to be met in respect of games where a super trigger does not occur. In such embodiments the feature game of the triggering game is conducted in the relevant display area.

In one example, the super free game feature results in the awarding of 5, 10 or 25 super free games depending on whether the trigger involves 3, 4, or 5 scattered symbols including a designated super feature game scatter symbol. During the super feature free game feature these games (i.e. 5, 10 or 25 games) are played in each of the four display areas. Such that the awarding of the feature results in effectively 20, 40 or 100 free games being conducted. During the free games, an extra WILD symbol is added to four reels of the five reel game. Additional feature games can be awarded with a scatter win occurring during play of the game.

As discussed above, in the embodiment, an eligibility criterion is applied for the player to be eligible for the super feature, requiring the player to play games in each of the display areas. In other embodiments, there could be additional eligibility criteria, for example that the player has selected at least two different games or different games in each display area, made a certain sized wager, made an ante bet, played sufficient games, or the player is a member of a loyalty program.

The base game is a part of the game which is carried out each time the player makes a wager, typically irrespective of the wager, whereas the feature game will be carried out occasionally upon the trigger occurring.

Persons skilled in the art will appreciate that a feature game involves some additional element of game play which usually only occurs when a trigger condition is met. Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game.

The trigger event may be, a symbol combination in the game, occurrence of a specific symbol in the game, purchased, be caused by another connected system, based on turnover, based on a random evaluation, etc.

A game round involves at least one of the reels being "spun"—e.g. new symbols of the reel are selected for display at the display positions. Persons skilled in the art will appreciate that there may be more than one game round in a play of a gaming machine such as is the case when a series of free spins is awarded. The outcome of a game round may be no win, a win (for example from a winning combination of symbols), a contribution towards a win accrued over a plurality of game rounds, a trigger condition occurring etc. Typically, a win will result in some form of award being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic method of gaming for use with a gaming machine having a plurality of display areas, a credit input mechanism configured to accept a credit for establishing a credit balance, the credit balance being increasable and decreasable, an output mechanism configured to cause a payout associated with the credit balance, a player interface, and a gaming controller, the electronic method of gaming comprising:

accepting via the credit input mechanism a credit;

in response to the credit having been accepted, establishing a credit balance;

receiving at the player interface a first player selection of both a first display area of the display areas and a first game to be conducted in the selected first display area of the display areas and a different second player selection of both a different second display area of the display areas and a different second game to be conducted in the different selected second display area of the display areas;

in accord with having established a credit balance, independently conducting via the gaming controller the first game and the different second game in the respective selected first display area and selected second display area of the plurality of display areas, and conducting the first game based on first game data specific to the first game and conducting the second game based on second game data specific to the second game, the first game data defining a set of first game play rules for the first game comprising a first base game portion carried out each time the first game is played in the selected first display area, a first feature game portion carried out upon a first trigger condition being met via play of the first game in the selected first display area and a first super feature game portion carried out upon a first super feature trigger condition being met via play of the first game in the selected first display area, and the second game data defining a set of second game play rules for the second game comprising a second base game portion carried out each time the second game is played in the selected second display area, a second feature game portion carried out upon a second trigger condition being met via play of the second game in the selected second display area, and a second super feature game portion carried out upon a second super feature trigger condition being met via play of the second game in the selected second display area;

upon at least one of the first trigger condition and the second trigger condition being met in the respective play of the first game and the second game, conducting via the gaming controller, in the respective selected first and second display areas, the respective one of the first feature game portion and the second feature game portion;

upon the first super feature trigger condition being met in the play of the first game, conducting via the game controller, in both the selected first and second display areas, the first super feature game portion;

determining via the game controller whether to make an award based on at least one of the first base game portion and second base game portion, the first feature game portion and the second feature game portion, and the first super feature game portion; and awarding a payout at the output mechanism in response to determining that an award is to be made.

2. The electronic method as claimed in claim 1, wherein the first game data includes another feature game portion, a single instance of which, is to be conducted upon another trigger condition being met by play of the first game.

3. The electronic method as claimed in claim 2, wherein the first feature game portion and the another feature game portion are different such that a difference in game play occurs upon the another trigger condition being met.

4. The electronic method as claimed in claim 1, further comprising determining that an eligibility criterion is met prior to conducting the first feature game portion.

5. The electronic method as claimed in claim 4, wherein the eligibility criterion comprises player selection of a defined minimum number of games to be conducted.

6. The electronic method as claimed in claim 5, wherein the eligibility criterion comprises player selection of games to be played in each of the first display area and the second display area.

7. The electronic method as claimed in claim 4 for use with a gaming machine having a plurality of reels for play of a game, comprising adjusting at least one of the reels of each game to enable the first trigger condition to be met in response to the eligibility criterion being met.

8. The electronic method as claimed in claim 1, wherein said conducting includes conducting a plurality of games; and wherein the number of the plurality of games is the same as the number of the plurality of display areas.

9. A gaming system, comprising:

a display having a plurality of display areas;

a credit input mechanism configured to accept a credit for establishing a credit balance, the credit balance being increasable and decreasable;

a player interface configured to receive a first player selection of both a first display area of the display areas and a first game to be conducted in the selected first display area of the display areas and a different second player selection of both a different second display area of the display areas and a different second game to be conducted in the different selected second display area of the display areas;

a memory storing first game data of the first game and second game data of the different second game, the first game data defining a set of first game play rules for play of the first game comprising a first base game portion carried out each time the first game is played, a first feature game portion carried out upon a first trigger condition being met via play of the first game, and a first super feature game portion carried out upon a first super feature trigger condition being met via play of the first game, and the second game data defining a set of second game play rules for play of the second game comprising a second base game portion carried out each time the second game is played, a second feature game portion carried out upon a second trigger condition being met via play of the second game, and a second super feature game portion carried out upon a second super feature trigger condition being met via play of the second game;

a game controller configured to 1) control the display to display the first display area and the second display area of the plurality of display areas and to conduct a first game and a second game within the respective selected first display area and selected second display area based on the first game data and second game data, 2) upon at least one of the first trigger condition and the second trigger condition being met in respect of one of the first game and second game, conduct, in each of the respective selected first display area and selected second display area, separate respective instances of at least one of the first feature game portion and the second feature game portion, 3) upon the first super feature trigger condition being met, conduct, in both the selected first display area and the selected second display area, instances of the first super feature game portion, and 4) to determine whether to make an award to the player; and an output mechanism configured to cause a payout associated with the credit balance in response to determining that an award is to be made.

10. A game controller for a gaming system having a display including a plurality of display areas, a player interface, a credit input mechanism configured to accept a credit for establishing a credit balance, the credit balance being increasable and decreasable, an output mechanism configured to cause a payout associated with the credit balance, the game controller configured to:

determine whether a credit has been accepted at the credit input mechanism, and in response to having accepted a credit, establish a credit balance;

receive at the player interface a first player selection of both a first display area of the display areas and a first game to be conducted in the selected first display area of the display areas and a different second player selection of both a different second display area of the display areas and a different second game to be conducted in the different selected second display area of the display areas;

control the display to display the selected first display area and the selected different second display area of the plurality of display areas;

in accord with having established a credit balance, conduct the first game and the different second game within the selected first display area and the selected second display area based on first game data and second game data of the respective ones of the first game and second game, the first game data defining a set of first game play rules for the first game comprising a first base game portion carried out each time the first game is played in the selected first display area, a first feature game portion carried out upon a first trigger condition being met via play of the first game in the selected first display area, and a first super feature game portion carried out upon a first super feature trigger condition being met via play of the first game in the selected first display area, and the second game data defining a set of second game play rules for the second game comprising a second base game portion carried out each time the second game is played in the selected second display area, a second feature game portion carried out upon a second trigger condition being met via play of the second game in the selected second display area, and a second super feature game portion carried out upon a second super feature trigger condition being met via play of the second game in the selected second display area;

upon at least one of the first trigger condition and the second trigger condition being met in respect of one of the first game and second game, conduct, in each of the respective selected first display area and the selected second display area, separate respective instances of at least one of the first feature game portion and the second feature game portion;

upon the first super feature trigger condition being met in the selected first display area, conduct, in both the selected first display area and the selected second display area, instances of the first super feature game portion;

determine whether to make an award based on at least one of the first base game portions and second base game portions, the first feature game portion and second feature game portion, and the first super feature game portion; and award a payout at the output mechanism in response to determining that an award is to be made.

11. The gaming system as claimed in claim 9, and further comprising a selection period; and wherein the game controller is further configured to control the player interface to display icons corresponding to each of the first game and second game; and and wherein the player interface is operable to receive a selection of an icon and move the icon to one display area of said plurality of display areas to thereby select the game and the one display area in which the game is to be conducted.

12. The gaming system as claimed in claim 11, wherein the player interface includes a touch screen operable by the player to move the icon.

* * * * *